US012352121B1

(12) United States Patent
Hillman

(10) Patent No.: US 12,352,121 B1
(45) Date of Patent: Jul. 8, 2025

(54) ANCHORING TOOLS AND RELATED METHODS

(71) Applicant: Saudi Arabian Oil Company, Dhahran (SA)

(72) Inventor: Thomas Hillman, Missouri City, TX (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/672,452

(22) Filed: May 23, 2024

(51) Int. Cl.
*E21B 23/01* (2006.01)

(52) U.S. Cl.
CPC ..... *E21B 23/01* (2013.01)

(58) Field of Classification Search
CPC ..... E21B 23/01
See application file for complete search history.

(56) References Cited

U.S. PATENT DOCUMENTS 6,892,811 B2 * 5/2005 LaClare ..... E21B 33/04 166/217
7,252,143 B2 * 8/2007 Sellers ..... E21B 23/01 73/152.56
8,443,900 B2 5/2013 Fielder et al.
10,472,212 B1 * 11/2019 Keisler ..... B66C 1/56
10,787,873 B2 9/2020 Biddick et al.
2007/0125550 A1 * 6/2007 Campbell ..... E21B 23/01 166/117.6
2012/0318532 A1 12/2012 Vaidya et al.
2016/0290081 A1 * 10/2016 Mlcak ..... E21B 23/01
2017/0350204 A1 * 12/2017 Moore ..... E21B 17/023
2023/0151701 A1 * 5/2023 Alexander ..... E21B 19/00 16/422

FOREIGN PATENT DOCUMENTS

WO WO-2023172666 A1 * 9/2023 ..... E21B 23/01

* cited by examiner

*Primary Examiner* — Aaron L Lembo
(74) *Attorney, Agent, or Firm* — Fish & Richardson P.C.

(57) ABSTRACT

An example anchoring device includes a support base and an adjustment mechanism connected to the support base. The adjustment mechanism includes a rotatable member, multiple first pivotable members connected to the rotatable member, and multiple second pivotable members connected to the support base. The rotatable member is rotatable in a first direction to cause the multiple first pivotable members and the multiple second pivotable members to pivot outwardly to provide an extended configuration of the adjustment mechanism and rotatable in a second direction to cause the multiple first pivotable members and the multiple second pivotable members to pivot inwardly to provide a collapsed configuration of the adjustment mechanism.

19 Claims, 5 Drawing Sheets

ANCHORING TOOLS AND RELATED METHODS

TECHNICAL FIELD

This disclosure relates to anchoring tools for securely positioning downhole equipment within a surrounding wall of a hollow structure, such as a wellbore or pipe. Such anchoring tools may include an adjustment mechanism that can be placed in an extended configuration and a collapsed configuration within the surrounding wall.

BACKGROUND

In wellbore drilling and exploration applications, various downhole devices require positioning and secure anchoring within wellbores and deployed piping. Anchoring systems may be utilized to provide these objectives and may be provided in different forms. Oftentimes, such anchoring systems lack adaptability to evolving well conditions. Accordingly, the anchoring systems are unable to be easily repositioned or removed (e.g., particularly when located upstream of a production tubing) such that they may effectively become permanent fixtures within a wellbore. Their deployment and utilization can thus result in reduced wellbore accessibility, which can lead to inefficiencies, extended downtime, and costly interventions.

SUMMARY

This disclosure relates to anchoring tools for securely positioning downhole equipment within a surrounding wall of a hollow structure, such as a wellbore or a pipe. In some embodiments, the anchoring tools may be further configured to seal annular regions around such equipment. An example anchoring tool includes a support base and an adjustment mechanism that includes a rotational device and multiple interconnected, pivotable members (e.g., arms, bars, structs, etc.). The adjustment mechanism of the anchoring tool is adjustable between an extended (e.g., expanded) configuration and a collapsed (e.g., folded) configuration via rotation of the rotational device with respect to the stationary base. Accordingly, the support base serves as a stationary point of reference with respect to the adjustment mechanism.

The details of one or more embodiments are set forth in the accompanying drawings and description. Other features, aspects, and advantages of the embodiments will become apparent from the description, drawings, and claims.

DETAILED DESCRIPTION

Figure 1:
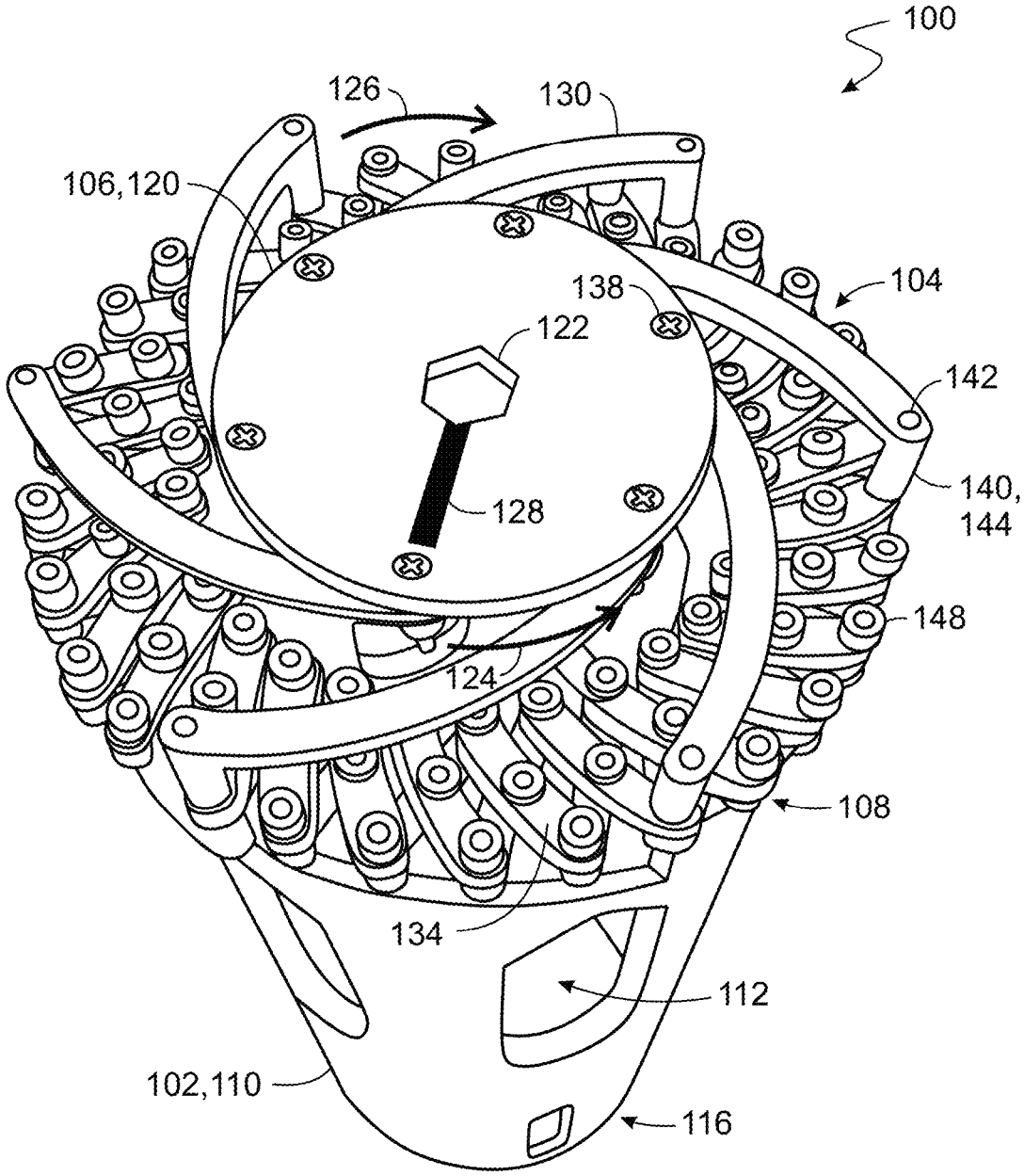
FIG. 1 is a top perspective view of an example anchoring tool with an adjustment mechanism of the anchoring tool in a fully collapsed configuration.
Figure 2:
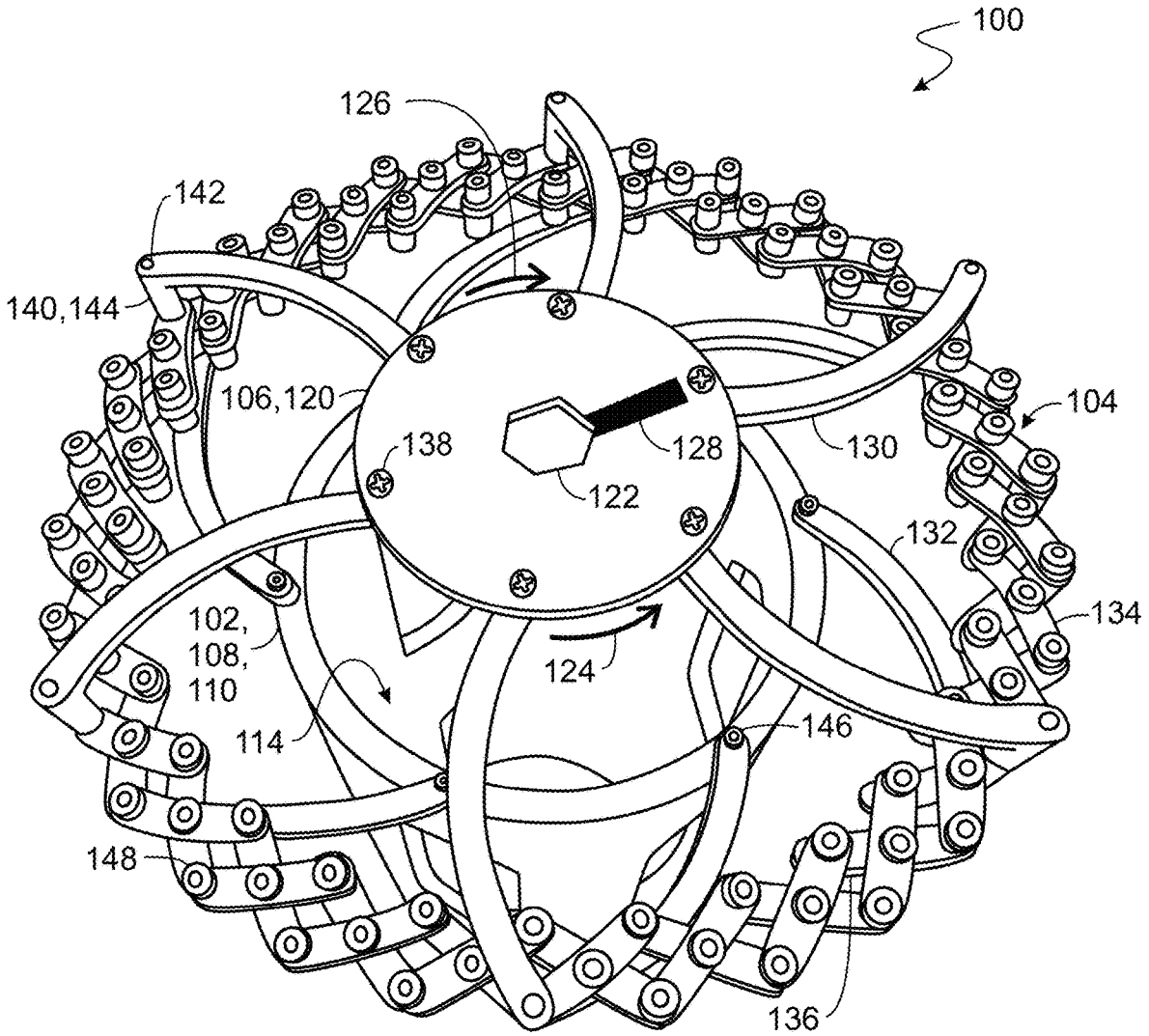
FIG. 2 is a top perspective view of the anchoring tool of FIG. 1 with the adjustment mechanism in a fully extended configuration.

FIGS. 1 and 2 illustrate an example anchoring tool 100 that is designed for securing a downhole device to a surrounding wall (e.g., indicated by dashed line 101 in FIG. 4) of a hollow structure, such as a wellbore or a pipe. In some embodiments, the anchoring tool 100 is adaptable to an internal width (e.g., an internal diameter) of the surrounding wall 101. For example, the anchoring tool 100 can extend radially outward to contact an inner surface of the surrounding wall 101 with enough force to securely fix the anchoring tool 100 to the wall 101 at the point of contact. In this manner, the anchoring tool 100 can secure a downhole device (e.g., itself, connected to the anchoring tool 100) to the surrounding wall 101. Example downhole devices that may be secured to the wall 101 with the anchoring tool 100 include sensors, plugs, detectors, wireline tools, valves, and other devices.

The anchoring tool 100 includes a support base 102 and an adjustable mechanism 104 that includes a rotatable member 106. The support base 102 is formed as a generally tubular shaped wall 110 with multiple lateral openings 112 in the wall 110. In some embodiments, the openings 112 serve to reduce an amount of material or weight of the anchoring tool 100. In some embodiments, an anchoring tool that is otherwise substantially similar in construction and function to the anchoring tool 100 does not include the openings 112. An uphole end 108 of the support base 102 defines an axial opening 114, and a downhole end 116 of the support base 102 defines an axial opening (not shown) such that fluids (e.g., wellbore fluid, drilling fluid, and other fluids) are permitted to flow through the support base 102 in multiple directions. In some embodiments, an anchoring tool that is otherwise substantially similar in construction and function to the anchoring tool 100 (e.g., one that is designed to serve as a temporary plug) may have a closed bottom end.

The support base 102 serves as a stationary element (e.g., a stator) that provides a fixed point of reference for the adjustment mechanism 104, which is attached to the uphole end 108 of the support base 102. The downhole end 116 of the support base 102 is attachable to the downhole device. While the anchoring tool 100 is illustrated with the adjustable mechanism 104 located above the support base 102, in other implementations, the anchoring tool 100 may be disposed in a reverse orientation within a surrounding wall 101, with the support base 102 located above the adjustable mechanism 104.

The adjustable mechanism 104 is positioned substantially in-line with (e.g., axially centered with respect to) the support base 102 and is movable with respect to the support base 102. For example, the adjustable mechanism 104 is extendable radially outward (e.g., expandable radially outward in all radial directions) to contact the inner surface of the surrounding wall 101. The adjustable mechanism 104 is also collapsible radially inward (e.g., capable of folding upon itself to shrink or contract in all radial directions) to release the adjustable mechanism 104 from the surrounding wall 101.

The rotatable member 106 of the adjustable mechanism 104 serves as a rotor that drives manipulation of the adjustable mechanism 104. In some embodiments, the rotatable member 106 is a plate 120 (e.g., a substantially disk-shaped plate or other-shaped plate) with an adjustment feature 122 formed on an outer, exposed side of the plate 120. In some embodiments, the adjustment feature 122 may be provided as a recessed structure, such as a receptacle, slot, notch, or other engageable recessed feature, as illustrated in FIGS.

1-4. In other embodiments, the adjustment feature 122 may be provided as a extended structure, such as an extension or a protrusion.

The adjustment feature 122 is accessible to a cooperating tool that can be engaged with the adjustment feature 122 to rotate the rotatable member 106 in a first angular direction 124 and in a second, opposite angular direction 126. In the illustrated example, the adjustment feature 122 has a hexagonal cross-sectional shape. However, in general, the adjustment feature 122 may have other shapes that are formed to engage with various cooperating tools. Example tools that may be used to rotate the plate 120 may include one or more of mechanical, hydraulic, electrical, and other elements or mechanisms. In some embodiments, the rotatable member 106 includes an indicator 128 (e.g., a marking, such as a line, or other type of visual indicator) on the plate 120 that indicates or otherwise corresponds to an angular position of the rotatable member 106 with respect to the support base 102. In some embodiments, an anchoring tool that is otherwise substantially similar in construction and function to the anchoring tool 100 may be driven by a different mechanism that produces rotary motion. For example, in a scenario for which hydraulic power is readily available downhole, a piston may be pushed along the axial direction by hydraulic pressure. Such axial motion of the piston may then be forced to rotate using a spiraling feature along an interior region of the support base 102, and the rotation of the piston may then be used to rotate the rotatable member 106.

In addition to the rotatable member 106, the adjustable mechanism 104 also includes first outer pivotable members 130 (e.g., rotor arms) that are connected to the plate 120, second outer pivotable members 132 (e.g., stator arms) that are connected to the uphole end 108 of the support base 102, first inner pivotable members 134, and second inner pivotable members 136. The inner pivotable members 134, 136 collectively connect the first outer pivotable members 130 to the second outer pivotable members 132. When the rotatable member 106 is turned, the rotatable member 106 imparts corresponding motions to the pivotable members 130, 132, 134, 136, which are connected to one another in hinged configurations.

The first outer pivotable members 130 are connected at first ends to the plate 120 (e.g., to an inner side of the plate 120 or to an outer side) at respective pivoting mechanisms 138 (e.g., pins, shoulder bolts, or other type of pins that can be held in place). In some embodiments, the pivoting mechanisms 138 are arranged along the path of a circle, such as a circumference of the plate 120. The pivotable members 130 are connected at second, opposite ends to certain first inner pivotable members 134 at respective pivoting mechanisms 140. Accordingly, the pivotable members 130 are pivotable with respect to both the rotatable member 106 and the pivotable members 134. In some embodiments, each pivoting mechanism 140 includes a pin 142 and a surrounding pin wall 144. The pivoting mechanisms 140 extend axially between the first outer pivotable members 130 and first inner pivotable members 134 such that the pivotable members 130 and pivotable members 134 are spaced axially apart.

The second outer pivotable members 132 are connected at first ends to the uphole end 108 of the support base 102 at respective pivoting mechanisms 146 (e.g., pins, shoulder bolts, or other type of pins that can be held in place). In some embodiments, the pivoting mechanisms 146 are arranged along the path of a circle, such as a circumference of the support base 102. The pivotable members 132 are connected at second, opposite ends to certain second inner pivotable members 136 at respective pivoting mechanisms (not visible). Accordingly, the pivotable members 132 are pivotable with respect to both the support base 102 and the pivotable members 136.

Referring particularly to FIG. 2, each first inner pivotable member 134 is connected at three different points (at opposite ends and at a center point) to respective second inner pivotable members 136 at pivoting mechanisms 148 (e.g., pins, shoulder bolts, or other type of pins that can be held in place). Likewise, each second inner pivotable member 136 is connected at three different points (at opposite ends and at a center point) to respective first inner pivotable members 134 at pivoting mechanisms 148. Accordingly, the first inner pivotable members 134 are pivotable with respect to both the first outer pivotable members 130 and the second inner pivotable members 136. Similarly, the second inner pivotable members 136 are pivotable with respect to both the first outer pivotable members 130 and the support base 102.

Within each set of pivotable members 130, 132, 134, 136, all members have the same length and the same shape curved or arcuate shape that allows the members to collapse into an arrangement that compactly falls within a circular cross-sectional area. Additionally, the length of the first inner pivotable members 134 is substantially equal to the length of the second inner pivotable members 136. The first outer pivotable members 130 are spaced approximately equally about a circumference of the rotatable member 106, and the second outer pivotable members 132 are spaced approximately equally about a circumference of the uphole end 108 of the support base 102.

In some embodiments, the pivotable members 130, 132, 134, 136, the rotatable member 106, and the support base 102 may be made of one or more rigid materials, such as metals that can withstand the downhole environment, plastics, or ceramics.

In some embodiments, the anchoring tool 100 may include a spring-loaded mechanism that exerts one or more inwardly directed forces on the adjustment mechanism 104 to maintain the adjustment mechanism 104 in the collapsed configuration (e.g., to bias the adjustment mechanism 104 to the collapsed configuration) when not in use. Example spring-loaded mechanisms may include a spiral spring or any other mechanism that translates axial motion of a simple spring into rotational motion. In some embodiments, the spring-loaded mechanism aids in efficient deployment and retrieval of the anchoring tool 100. Accordingly, adjustment tools capable of overcoming the spring-loaded state of the adjustment mechanism 104 are selected for use with the rotatable member 106 during operation of the anchoring tool 100.

Figure 3:
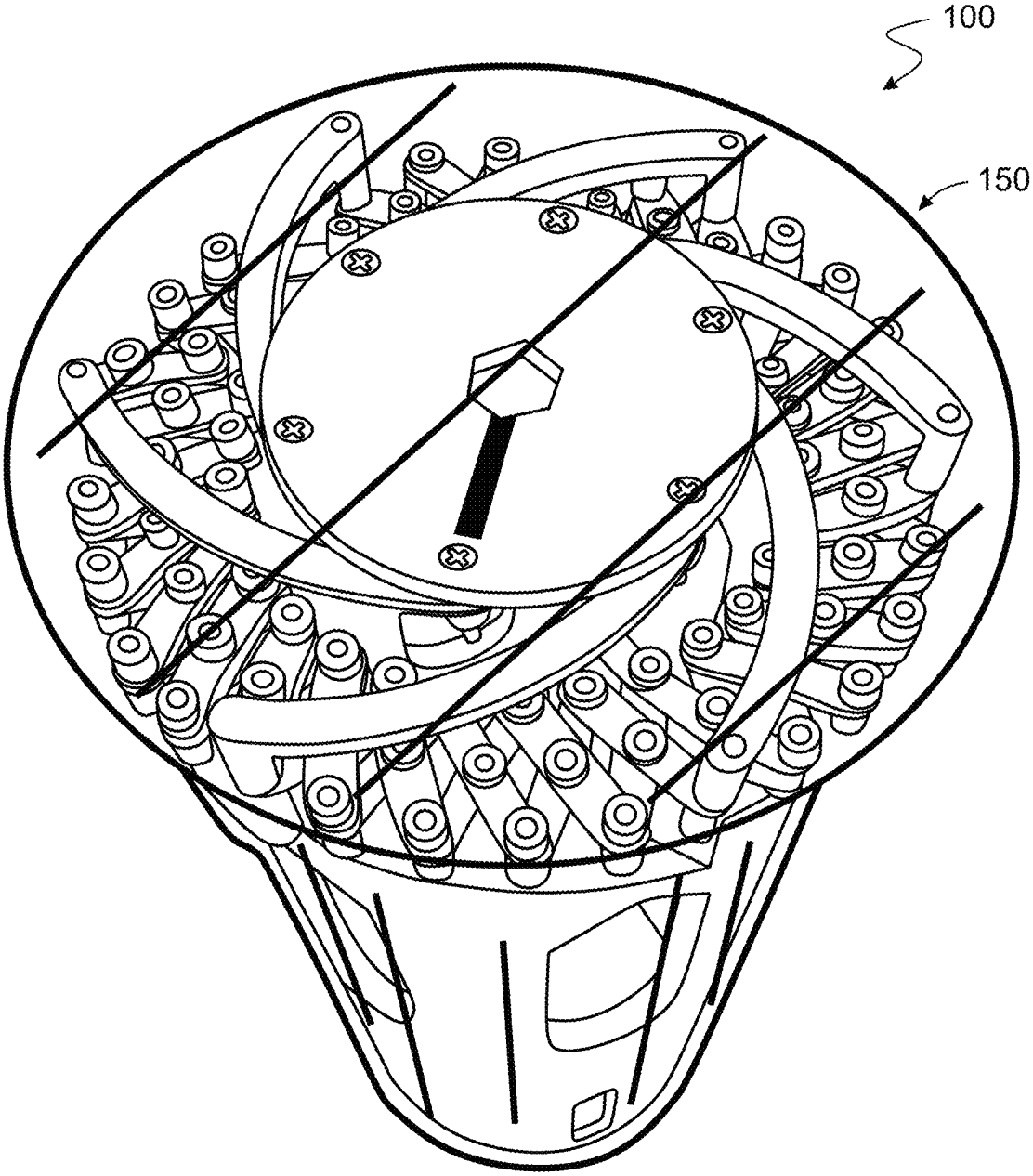
FIG. 3 is a top perspective view of the anchoring tool with the adjustment mechanism of the anchoring tool in the fully collapsed configuration of FIG. 1 and with an elastic cover surrounding internal components of the anchoring tool.

Referring to FIG. 3, in some embodiments, the anchoring tool 100 further includes an elastic cover 150 (e.g., a shroud) that surrounds all or a portion of the anchoring tool 100. For example, the elastic cover 150 may surround the lateral surface of the adjustment mechanism 104, all exposed surfaces of the adjustment mechanism 104, the lateral surface of the support base 102, and/or all exposed surfaces of the support base 102. In some embodiments, the elastic cover 150 may be made or rubber or another elastic material.

When surrounding at least a lateral surface of the adjustment mechanism 104, the elastic cover 150 increases a frictional force between the anchoring tool 100 and the surrounding wall 101 when the adjustment mechanism 104 is in contact with the wall 101, thereby reducing a clamping force necessary to fix the anchoring tool 100 in place at the target axial position. Such contact also creates a circumferential seal against the inner surface of the surrounding wall 101. For example, the elastic cover 150 may prevent fluid from flowing laterally between the adjustment mechanism 104 and the surrounding wall 101. In embodiments where the elastic cover 150 surrounds the entire anchoring tool 100 (as shown in FIG. 3), the elastic cover 150 effectively completely eliminates fluid flow past the anchoring tool 100 within the wall 101. For such embodiments, the anchor tool 100 functions as a packer that provides isolation within the surrounding wall 101.

In operation, the anchoring tool 100 is equipped with a downhole device (e.g., at the downhole end 116 of the support base 102) and placed in a collapsed configuration (e.g., with a maximum diameter that is less than an inner diameter of the surrounding wall 101). For example, an adjustment tool is engaged with the adjustment feature 122 of the rotatable member 106 of the adjustment mechanism 104 and operated to rotate the rotatable member 106 in the second angular direction 126. The anchoring tool 100, with the downhole device attached, is then moved within the surrounding wall 101 to a target axial position along a length of the wall 101.

Figure 4:
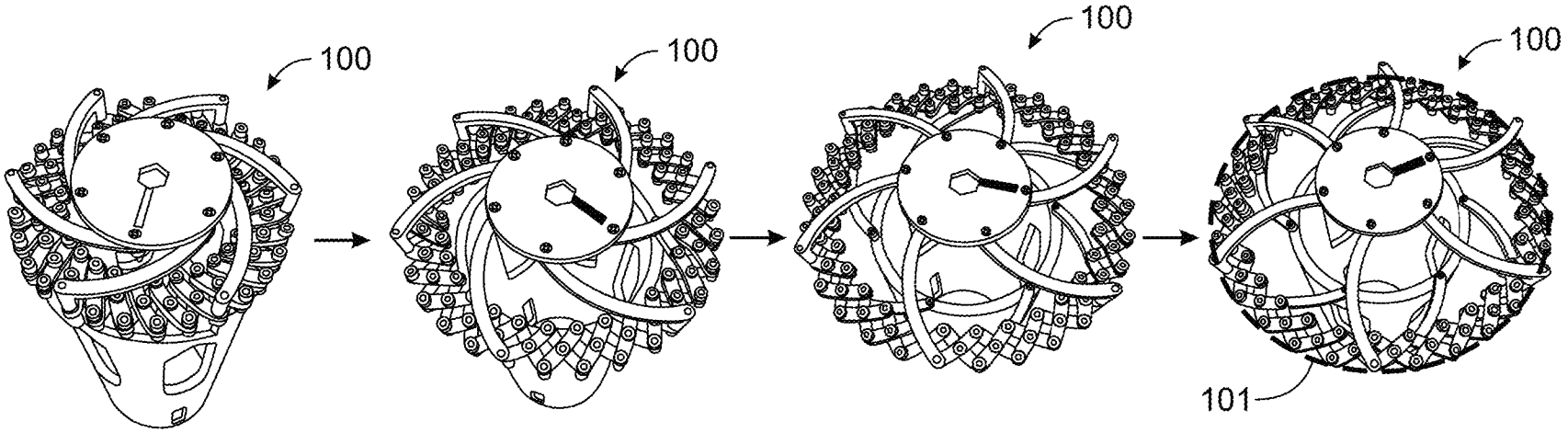
FIG. 4 illustrates a sequential extension of the adjustable mechanism of the anchoring tool of FIG. 1 as a rotatable member is rotated within a surrounding wall.

Once at the target axial position, an adjustment tool can be engaged with the adjustment feature 122 and operated to rotate the rotatable member 106 in a controlled manner in the first angular direction 124. As a result, the pivotable members 130, 132, 134, 136 move, as described above, to extend radially outward until outer ends of the pivotable members 130, 132, 134, 136 contact (e.g., push against or dig into) the surrounding wall 101. The rotatable member 106 can be rotated until the pivotable members 132, 134, 136 exert a radially outward force (e.g., a clamping force) on the surrounding wall 101 that is sufficient to securely maintain the anchoring tool 100 against the wall (e.g., to anchor the anchoring tool 100 to the wall 101) at the target axial position. In this manner, the adjustment mechanism 104 is dynamically and structurally adaptable to a size (e.g., an inner diameter) of the surrounding wall 101. FIG. 4 illustrates a sequential extension of the adjustable mechanism 104 as the rotatable member 106 is rotated within the surrounding wall 101.

Once it is desired to retrieve the anchoring tool 100 from the surrounding wall 101 or reposition the anchoring tool 100 within the surrounding wall 101, then the rotatable member 106 can subsequently be rotated again in the second direction 126 to radially collapse the adjustment mechanism 104 to a compact state. Collapse of the adjustment mechanism 104 releases the anchoring tool 100 from the wall 101 to allow movement within the wall 101. In this way, the anchoring tool 100 lacks permanency within the surrounding wall 101.

The anchoring tool 100 offers a offers a wide range of applications in the drilling, exploration, and wellbore maintenance industries. In some embodiments, the anchoring tool 100 may be utilized for downhole tool positioning at specific depths within a wellbore to allow for precise data collection, sampling, and maintenance operations. In some embodiments, the anchoring tool 100 may be utilized in wellbore construction, such as to facilitate the installation of casing, liners, or other components, by temporarily anchoring them in place during construction. In some embodiments, the anchoring tool 100 may be utilized in flow control by regulating fluid flow within a wellbore by selectively anchoring of the tool 100 and leaving of the tool 100 in place. In some embodiments, the anchoring tool 100 may be utilized in wellbore intervention operations, thereby enabling efficient and adaptable wellbore interventions, such as plug setting, perforation, and well stimulation. In some embodiments, the anchoring tool 100 may be utilized in oil and gas extraction operations, thereby supporting enhanced oil and gas recovery by optimizing wellbore configurations for production and injection operations.

Figure 5:
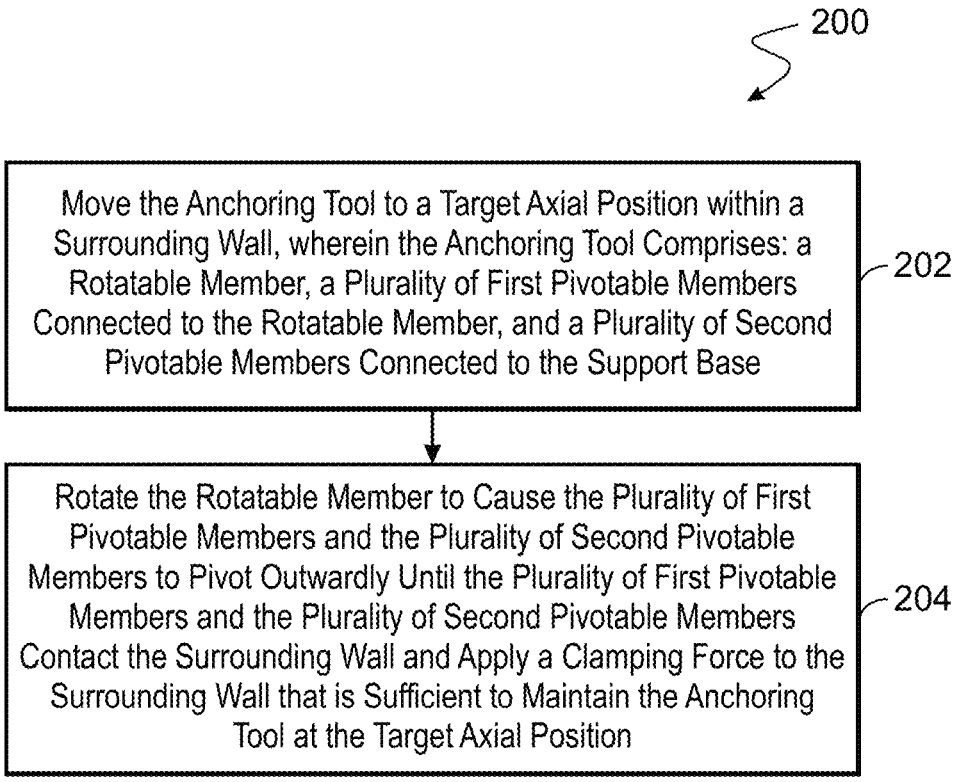
FIG. 5 is a flow chart illustrating an example method of using the anchoring tool of FIG. 1.

FIG. 5 is a flow chart illustrating an example method 200 of using an anchoring tool (e.g., the anchoring tool 100). In some embodiments, the method 200 includes a step 202 for moving the anchoring tool to a target axial position within a surrounding wall (e.g., the surrounding wall 101), wherein the anchoring tool includes a support base (e.g., the support base 102) and an adjustment mechanism (e.g., the adjustment mechanism 104) connected to the support base, wherein the support base includes a rotatable member (e.g., the rotatable member 106), multiple first pivotable members (e.g., the pivotable members 130) connected to the rotatable member, and multiple second pivotable members (e.g., the pivotable members 132) connected to the rotatable member. In some embodiments, the method 200 includes a step 204 for rotating the rotatable member to cause the multiple first pivotable members and the multiple second pivotable members to pivot outwardly until the multiple first pivotable members and the multiple second pivotable members contact the surrounding wall and apply a clamping force to the surrounding wall that is sufficient to maintain the anchoring tool at the target axial position.

While the anchoring tool 100 has been described and illustrated with respect to certain dimensions, sizes, shapes, arrangements, materials, and methods 200, in some embodiments, an anchoring tool that is otherwise similar in construction and/or function to the anchoring tool 100 may include one or more different dimensions, sizes, shapes, arrangements, configurations, or materials, or be operated according to different methods.

EXAMPLES

In an example aspect, an anchoring tool includes a support base and an adjustment mechanism connected to the support base. The adjustment mechanism includes a rotatable member, multiple first pivotable members connected to the rotatable member, and multiple second pivotable members connected to the support base. The rotatable member is rotatable in a first direction to cause the multiple first pivotable members and the multiple second pivotable members to pivot outwardly to provide an extended configuration of the adjustment mechanism and rotatable in a second direction to cause the multiple first pivotable members and the multiple second pivotable members to pivot inwardly to provide a collapsed configuration of the adjustment mechanism.

Embodiments may provide one or more of the following features.

In an example aspect combinable with any other example aspect, the multiple first pivotable members and the multiple second pivotable members are configured to move together collectively to provide the extended and collapsed configurations of the adjustment mechanism.

In an example aspect combinable with any other example aspect, the adjustment mechanism is configured to apply a clamping force on a surrounding wall to fix a position of the anchoring tool with respect to the surrounding wall.

In an example aspect combinable with any other example aspect, the multiple first pivotable members are coupled to the multiple second pivotable members.

In an example aspect combinable with any other example aspect, the adjustment mechanism further includes multiple third pivotable members that are connected to the multiple first pivotable members and multiple fourth pivotable members that are connected to the multiple third pivotable members and the multiple second pivotable members.

In an example aspect combinable with any other example aspect, the multiple first pivotable members and the multiple second pivotable members are longer than the multiple third pivotable members and the multiple fourth pivotable members In an example aspect combinable with any other example aspect, the multiple first pivotable members and the multiple second pivotable members have a curved shape.

In an example aspect combinable with any other example aspect, the support base includes a stator and the rotatable member includes a rotor.

In an example aspect combinable with any other example aspect, the rotatable member includes a plate.

In an example aspect combinable with any other example aspect, the plate includes an adjustment feature by which the plate can be rotated.

In an example aspect combinable with any other example aspect, the plate further includes an indicator that indicates an angular position of the rotatable member with respect to the support base.

In an example aspect combinable with any other example aspect, the support base includes one or more lateral openings.

In an example aspect combinable with any other example aspect, the support base is configured to support a downhole device.

In an example aspect combinable with any other example aspect, the anchoring tool further includes an elastic cover that surrounds at least a portion of the adjustment mechanism.

In an example aspect combinable with any other example aspect, the anchoring tool further includes a spring-loaded mechanism that biases the adjustment mechanism to the collapsed configuration.

In another example aspect, a method of using an anchoring tool includes moving the anchoring tool to a target axial position within a surrounding wall, wherein the anchoring tool includes a support base and an adjustment mechanism connected to the support base, wherein the adjustment mechanism includes a rotatable member, multiple first pivotable members connected to the rotatable member, and multiple second pivotable members connected to the support base. The method further includes rotating the rotatable member to cause the multiple first pivotable members and the multiple second pivotable members to pivot outwardly until the multiple first pivotable members and the multiple second pivotable members contact the surrounding wall and apply a clamping force to the surrounding wall that is sufficient to maintain the anchoring tool at the target axial position.

Embodiments may provide one or more of the following features.

In an example aspect combinable with any other example aspect, the method further includes securing a downhole device to the anchoring tool before moving the anchoring tool to the target axial position.

In an example aspect combinable with any other example aspect, the multiple first pivotable members are coupled to the multiple second pivotable members.

In an example aspect combinable with any other example aspect, causing the multiple first pivotable members and the multiple second pivotable members to pivot outwardly includes moving the multiple first pivotable members and the multiple second pivotable members together collectively to provide an extended configuration of the adjustment mechanism.

In an example aspect combinable with any other example aspect, the method further includes rotating the rotatable member in an opposite direction to cause the multiple first pivotable members and the multiple second pivotable members to pivot inwardly to release the anchoring tool from the surrounding wall.

The above-discussed examples and other examples are within the scope of the following claims.

What is claimed is:

1. An anchoring tool comprising:

a support base configured to support a downhole device; and an adjustment mechanism connected to the support base and comprising:

a rotatable member, a plurality of first pivotable members connected to the rotatable member, and a plurality of second pivotable members connected to the support base, wherein the rotatable member is rotatable:

in a first direction to cause the plurality of first pivotable members and the plurality of second pivotable members to pivot outwardly to provide an extended configuration of the adjustment mechanism, and in a second direction to cause the plurality of first pivotable members and the plurality of second pivotable members to pivot inwardly to provide a collapsed configuration of the adjustment mechanism.

2. The anchoring tool of claim 1, wherein the plurality of first pivotable members and the plurality of second pivotable members are configured to move together collectively to provide the extended and collapsed configurations of the adjustment mechanism.

3. The anchoring tool of claim 1, wherein the adjustment mechanism is configured to apply a clamping force on a surrounding wall to fix a position of the anchoring tool with respect to the surrounding wall.

4. The anchoring tool of claim 1, wherein the plurality of first pivotable members are coupled to the plurality of second pivotable members.

5. The anchoring tool of claim 4, wherein the adjustment mechanism further comprises a plurality of third pivotable members that are connected to the plurality of first pivotable members and a plurality of fourth pivotable members that are connected to the plurality of third pivotable members and the plurality of second pivotable members.

6. The anchoring tool of claim 5, wherein the plurality of first pivotable members and the plurality of second pivotable members are longer than the plurality of third pivotable members and the plurality of fourth pivotable members.

7. The anchoring tool of claim 1, wherein the plurality of first pivotable members and the plurality of second pivotable members have a curved shape.

8. The anchoring tool of claim 1, wherein the support base comprises a stator and the rotatable member comprises a rotor.

9. The anchoring tool of claim 1, wherein the rotatable member comprises a plate.

10. The anchoring tool of claim 9, wherein the plate comprises an adjustment feature by which the plate can be rotated.

11. The anchoring tool of claim 9, wherein the plate further comprises an indicator that indicates an angular position of the rotatable member with respect to the support base.

12. The anchoring tool of claim 1, wherein the support base comprises one or more lateral openings.

13. The anchoring tool of claim 1, further comprising an elastic cover that surrounds at least a portion of the adjustment mechanism.

14. The anchoring tool of claim 1, further comprising a spring-loaded mechanism that biases the adjustment mechanism to the collapsed configuration.

15. A method of using an anchoring tool, the method comprising:

securing a downhole device to a support base of the anchoring tool;

moving the anchoring tool, with the support base supporting the downhole device, to a target axial position within a surrounding wall, wherein the anchoring tool further comprises:

an adjustment mechanism connected to the support base and comprising:

a rotatable member, a plurality of first pivotable members connected to the rotatable member, and a plurality of second pivotable members connected to the support base; and rotating the rotatable member to cause the plurality of first pivotable members and the plurality of second pivotable members to pivot outwardly until the plurality of first pivotable members and the plurality of second pivotable members contact the surrounding wall and apply a clamping force to the surrounding wall that is sufficient to maintain the anchoring tool at the target axial position.

16. The method of claim 15, wherein the plurality of first pivotable members are coupled to the plurality of second pivotable members.

17. The method of claim 15, wherein causing the plurality of first pivotable members and the plurality of second pivotable members to pivot outwardly comprises moving the plurality of first pivotable members and the plurality of second pivotable members together collectively to provide an extended configuration of the adjustment mechanism.

18. The method of claim 15, further comprising rotating the rotatable member in an opposite direction to cause the plurality of first pivotable members and the plurality of second pivotable members to pivot inwardly to release the anchoring tool from the surrounding wall.

19. An anchoring tool comprising:

a support base comprising one or more lateral openings; and an adjustment mechanism connected to the support base and comprising:

a rotatable member, a plurality of first pivotable members connected to the rotatable member, and a plurality of second pivotable members connected to the support base, wherein the rotatable member is rotatable:

in a first direction to cause the plurality of first pivotable members and the plurality of second pivotable members to pivot outwardly to provide an extended configuration of the adjustment mechanism, and in a second direction to cause the plurality of first pivotable members and the plurality of second pivotable members to pivot inwardly to provide a collapsed configuration of the adjustment mechanism.

* * * * *